US011873602B2

(12) United States Patent
Park

(10) Patent No.: US 11,873,602 B2
(45) Date of Patent: Jan. 16, 2024

(54) LAUNDRY TREATING APPARATUS

(71) Applicant: LG Electronics Inc., Seoul (KR)

(72) Inventor: Junghyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 126 days.

(21) Appl. No.: 17/399,635

(22) Filed: Aug. 11, 2021

(65) Prior Publication Data

US 2022/0049402 A1 Feb. 17, 2022

(30) Foreign Application Priority Data

Aug. 14, 2020 (KR) ..... 10-2020-0102613

(51) Int. Cl.
*D06F 37/40* (2006.01)
*D06F 37/24* (2006.01)
*D06F 23/04* (2006.01)

(52) U.S. Cl.
CPC ..... *D06F 37/40* (2013.01); *D06F 23/04* (2013.01); *D06F 37/24* (2013.01)

(58) Field of Classification Search
None
See application file for complete search history.

(56) References Cited

U.S. PATENT DOCUMENTS 4,048,820 A * 9/1977 Pielemeier ..... D06F 13/00 366/277
4,068,503 A * 1/1978 Platt ..... D06F 13/00 68/133
5,865,047 A * 2/1999 Yoon ..... D06F 17/10 68/134
10,151,058 B2 * 12/2018 Carpenter ..... D06F 3/04
2005/0284197 A1 * 12/2005 Pinkowski ..... D06F 13/02 68/133

* cited by examiner

*Primary Examiner* — Cristi J Tate-Sims
(74) *Attorney, Agent, or Firm* — Fish & Richardson P.C.

(57) ABSTRACT

Disclosed is a laundry treating apparatus having a rotator. The rotator includes a bottom portion positioned on a bottom surface of a drum, a pillar protruding from the bottom portion toward an open surface of the drum, and a blade protruding from an outer circumferential surface of the pillar, wherein the blade extends from one end thereof facing toward the bottom surface to the other end thereof facing toward the open surface, and the blade is disposed such that said one end thereof is spaced apart from the bottom portion. As such, a washing power may be increased regardless of an amount of laundry, and a torque load of a driver may be reduced.

20 Claims, 8 Drawing Sheets

LAUNDRY TREATING APPARATUS

CROSS-REFERENCE TO RELATED APPLICATIONS

This application claims the benefit of Korean Patent Application No. 10-2020-0102613, filed on Aug. 14, 2020, which is hereby incorporated by reference as if fully set forth herein.

TECHNICAL FIELD

The present disclosure relates to a laundry treating apparatus, and more particularly, to a laundry treating apparatus having a rotator disposed in a drum.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Korean Patent No. 10-0186729 discloses a laundry treating apparatus including a rotator disposed inside a drum. The laundry treating apparatus improves a washing efficiency by rotating the rotator to form a water flow.

An efficient design is required for the rotator such that the water flow formed by the rotation may improve the washing efficiency. Furthermore, a design that may effectively reduce a load on a motor by effectively reducing a load on the rotation of the rotator is required.

Therefore, it is an important task in the art to design the rotator such that the rotator may rotate to effectively improve the washing efficiency and the load on the rotation of the rotator may be effectively reduced.

In one example, the laundry treating apparatus may wash a small amount of laundry and a large amount of laundry. Depending on the amount of laundry, the water flow by the rotation of the rotator may vary. In addition, a load transfer of the rotator may vary depending on the amount of laundry. Accordingly, a load of the driver driving the rotator may also vary.

Therefore, it is required to design a rotator that reduces resistance in the generation of the water flow of the rotator regardless of the amount of laundry. In addition, a design of the rotator for reducing the load on the driver resulted from the load transfer of the rotator regardless of the amount of laundry is required.

SUMMARY

Embodiments of the present disclosure are intended to provide a laundry treating apparatus including a rotator that forms a water flow that may effectively improve a washing efficiency.

In addition, embodiments of the present disclosure are intended to provide a laundry treating apparatus in which resistance of a water flow generated by a rotator is reduced to increase a washing power when a small amount of laundry is washed while a blade is spaced apart from a bottom portion in a longitudinal direction.

In addition, embodiments of the present disclosure are intended to provide a laundry treating apparatus that reduces a load on a driver for rotating a rotator when a small amount of laundry is washed while a blade is spaced apart from a bottom portion in a longitudinal direction.

In addition, embodiments of the present disclosure are intended to provide a laundry treating apparatus in which a washing power is increased by reducing resistance of a water flow generated by a rotator when a large amount of laundry is washed while a blade is spaced apart from a bottom portion in a circumferential direction.

In addition, embodiments of the present disclosure are intended to provide a laundry treating apparatus that reduces a load on a driver for rotating a rotator when a large amount of laundry is washed while a blade is spaced apart from a bottom portion in a circumferential direction.

A rotator disposed inside a drum may include a bottom portion and a pillar. The pillar may also be referred to as an agitator. The rotator according to an embodiment of the present disclosure may improve a washing efficiency and implement a washing scheme differentiated from a conventional scheme.

The bottom portion may also be referred to as a pulsator. In one embodiment of the present disclosure, a protrusion portion of the bottom portion may be constructed to have a shape of a whale tail and reduce resistance to water when rotating.

The protrusion portion of the bottom portion and the blade of the pillar may together form water flows at an upper portion and a lower portion of an interior of the drum together, thereby forming a differentiated water flow inside the drum and effectively improving a washing efficiency.

The blade of the pillar may be spaced apart from the protrusion portion of the bottom portion, so that the resistance may be reduced in the formation of the water flow regardless of whether a small amount or a large amount of laundry is washed. In addition, as load transfer in the rotator is performed smoothly, a driver torque load may be reduced.

A laundry treating apparatus may include a tub for providing therein a space for water to be stored, a drum rotatably disposed inside the tub, wherein the drum includes an open surface for inserting and withdrawing laundry therethrough and a bottom surface located on an opposite side of the open surface, and a rotator rotatably disposed on the bottom surface and inside the drum.

The rotator may include a bottom portion positioned on the bottom surface, a pillar protruding from the bottom portion toward the open surface, and a blade protruding from an outer circumferential surface of the pillar, wherein the blade extends from one end thereof facing toward the bottom surface to the other end thereof facing toward the open surface. The blade may be disposed such that said one end thereof is spaced apart from the bottom portion.

In addition, the bottom portion may include a protrusion portion protruding from the bottom portion toward the open surface and extending along a radial direction of the bottom portion, and said one end may be disposed to be spaced apart from the protrusion portion.

In addition, the protrusion portion may include a main protrusion extending from an inner end thereof facing toward a center of the bottom portion to an outer end thereof facing toward a circumference of the bottom portion, and the inner end may be connected to the pillar.

In addition, said one end may be disposed to be spaced apart from the inner end by a first spaced distance in a longitudinal direction of the pillar.

In addition, said one end may be disposed to be spaced apart from the inner end by a second spaced distance in a circumferential direction of the pillar.

In addition, the first spaced distance may be greater than the second spaced distance.

In addition, the inner end may have a height from the bottom surface greater than the first spaced distance and the second spaced distance.

In addition, the main protrusion may extend such that a height thereof from the bottom surface decreases from the inner end to the outer end.

In addition, a plurality of main protrusions may be disposed to be spaced apart from each other along a circumferential direction of the bottom portion, and the protrusion portion may further include a plurality of first sub-protrusions, wherein each first sub-protrusion is disposed between a pair of main protrusions, and has a protruding height from the bottom portion smaller than a protruding height of the main protrusion.

In addition, the protrusion portion may further include a plurality of second sub-protrusions, wherein each set of the second sub-protrusions is disposed between each main protrusion and each first sub-protrusion, wherein a protruding height from the bottom portion of the second sub-protrusion is smaller than the protruding height of the first sub-protrusion.

In addition, a plurality of blades may be disposed to be spaced apart from each other along a circumferential direction of the pillar, and the blade may extend from said one end thereof to the other end thereof to be inclined to one side with respect to a longitudinal direction of the pillar.

In addition, the pillar may be formed in a hollow shape, and the rotator may further include a cap coupled to an end of the pillar to close an interior of the pillar.

According to embodiments of the present disclosure, it is possible to provide the laundry treating apparatus including the rotator that forms the water flow that may effectively improve the washing efficiency.

In addition, according to embodiments of the present disclosure, it is possible to provide the laundry treating apparatus that may improve the washing power when washing the small amount of laundry, and may effectively reduce the load on the rotation of the rotator.

In addition, according to embodiments of the present disclosure, it is possible to provide the laundry treating apparatus that may improve the washing power when washing the large amount or laundry, and may effectively reduce the load on the rotation of the rotator.

DETAILED DESCRIPTION

Figure 1:
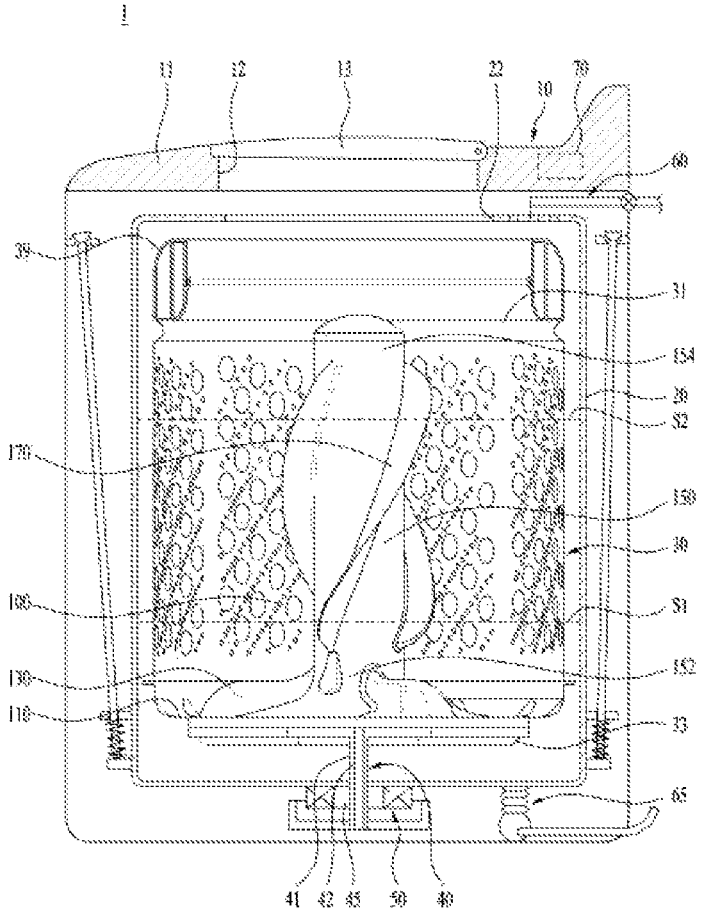
FIG. 1 is a view showing an interior of a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

FIG. 1 shows that a laundry inlet 12 is defined in a top surface 11 of a cabinet 10 according to an embodiment of the present disclosure, and a laundry door 13 for opening and closing the laundry inlet 12 is disposed on the top surface 11. However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a tub support. The tub support may be in a structure capable of damping vibrations generated in the tub 20.

The tub 20 is supplied with water through a water supply 60. The water supply 60 may be composed of a water supply pipe that connects a water supply source with the tub 20, and a valve that opens and closes the water supply pipe.

The laundry treating apparatus 1 according to an embodiment of the present disclosure may include a detergent feeder that stores detergent therein and is able to supply the detergent into the tub 20. As the water supply 60 supplies water to the detergent feeder, the water that has passed through the detergent feeder may be supplied to the tub 20 together with the detergent.

In addition, the laundry treating apparatus 1 according to an embodiment of the present disclosure may include a water sprayer that sprays water into the tub 20 through the tub opening 22. The water supply 60 may be connected to the water sprayer to supply water directly into the tub 20 through the water sprayer.

The water stored in the tub 20 is discharged to the outside of the cabinet 10 through a drain 65. The drain 65 may be composed of a drain pipe that guides the water inside the tub 20 to the outside of the cabinet 10 and a drain pump disposed on the drain pipe.

The drum 30 may be rotatably disposed inside the tub 20. The drum 30 may be constructed to have a circular cross-section in order to be rotatable inside the tub 20. For example, the drum 30 may be in a cylindrical shape as shown in FIG. 1.

The drum 30 may have a drum opening defined therein positioned below the tub opening 22 to communicate with the inlet. One surface of the drum 30 may be opened to define an open surface 31 as will be described later, and the open surface 31 may correspond to the drum opening.

A plurality of drum through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the drum through-holes.

The drum 30 may be rotated by a driver 50. The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, the rotation shaft 40 may be disposed to form a right angle with respect to a bottom surface of the tub 20. In this case, the laundry inlet 12 may be defined in the top surface 11 of the cabinet 10, the tub opening 22 may be defined in the top surface of the tub 20, and the drum opening may be defined in the top surface of the drum 30.

In one example, when the drum 30 rotates in a state in which the laundry is concentrated in a certain region inside the drum 30, a dynamic unbalance state (an unbalanced state) occurs in the drum 30. When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, referring to FIG. 1, the tub 20 may have a space defined therein in which the water may be stored, and the drum 30 may be rotatably disposed inside the tub 20. The drum 30 may include the open surface 31 through which the laundry enters and exits, and a bottom surface 33 positioned on an opposite side of the open surface 31.

FIG. 1 shows that the top surface of the drum 30 corresponds to the open surface 31, and the bottom surface thereof corresponds to the bottom surface 33 according to an embodiment of the present disclosure. As described above, the open surface 31 may correspond to a surface through which the laundry input through the laundry inlet 12 of the cabinet 10 and the tub opening 22 of the tub 20 passes.

In one example, the water supply 60 may be constructed to be connected to the means such as the detergent feeder, the water sprayer, or the like to supply the water into the tub 20 as described above. In one example, an embodiment of the present disclosure may include a controller 70 that controls the water supply 60 to adjust a water supply amount in a washing process and the like.

The controller 70 is configured to adjust the amount of water supplied to the tub 20 in the washing process, a rinsing process, or the like. The amount of water supplied may be adjusted through a manipulation unit disposed on the cabinet 10 and manipulated by a user, or may be determined through an amount of laundry, a load of the driver 50, or the like.

A plurality of water supply amounts are preset in the controller 70, and the controller 70 may be configured to control the water supply 60 based on one of the preset water supply amounts in response to a command selected by a user or the like in the washing process or the like.

In one example, as shown in FIG. 1, an embodiment of the present disclosure may further include a rotator 100. The rotator 100 may be rotatably installed on the bottom surface 33 and inside the drum 30.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
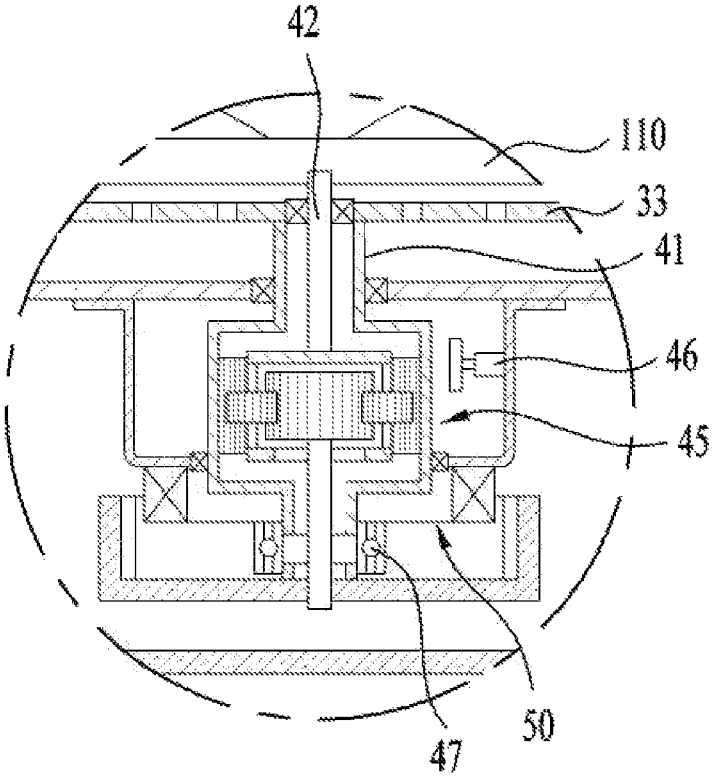
FIG. 2 is a view showing a rotation shaft coupled to a drum and a rotator in a laundry treating apparatus according to an embodiment of the present disclosure.

In one example, FIG. 2 shows the rotation shaft 40 coupled with the drum 30 and the rotator 100 according to an embodiment of the present disclosure.

Each of the drum 30 and the rotator 100 may be connected to the driver 50 through the rotation shaft 40 to receive a rotational force. In one embodiment of the present disclosure, the drum 30 may be rotated as a first rotation shaft 41 is coupled to the bottom surface 33 thereof, and the rotator 100 may be rotated by being coupled to a second rotation shaft 42 that passes through the bottom surface 33 and separately rotated with respect to the first rotation shaft 41.

The second rotation shaft 42 may rotate in a direction the same as or opposite to a rotation direction of the first rotation shaft 41. The first rotation shaft 41 and the second rotation shaft 42 may receive power through one driver 50, and the driver 50 may be connected to a gear set 45 that distributes the power to the first rotation shaft 41 and the second rotation shaft 42 and adjusts the rotation direction.

That is, a driving shaft of the driver 50 may be connected to the gear set 45 to transmit the power to the gear set 45, and each of the first rotation shaft 41 and the second rotation shaft 42 may be connected to the gear set 45 to receive the power.

The first rotation shaft 41 may be constructed as a hollow shaft, and the second rotation shaft 42 may be constructed as a solid shaft disposed inside the first rotation shaft 41. Accordingly, one embodiment of the present disclosure may effectively provide the power to the first rotation shaft 41 and the second rotation shaft 42 parallel to each other through the single driver 50.

FIG. 2 shows a planetary gear-type gear set 45, and shows a state in which each of the driving shaft, the first rotation shaft 41, and the second rotation shaft 42 is coupled to the gear set 45. Referring to FIG. 2, a rotational relationship of the first rotation shaft 41 and the second rotation shaft 42 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 41 coupled to the bottom surface 33 of the drum 30 may be connected to the ring gear positioned at the outermost portion of the gear set 45. The second rotation shaft 42 coupled to the rotator 100 may be connected to the satellite gear disposed between the sun gear and the ring gear in the gear set 45.

In one example, the gear set 45 may include a first clutch element 46 and a second clutch element 47 that may restrict the rotation of each of the rotation shafts 40 as needed. The gear set 45 may further include a gear housing fixed to the tub 20, and the first clutch element 46 may be disposed in the gear housing to selectively restrict the rotation of the first rotation shaft 41 connected to the ring gear.

The second clutch element 47 may be constructed to mutually restrict or release the rotations of the driving shaft and the ring gear. That is, the rotation of the ring gear or the rotation of the first rotation shaft 41 may be synchronized with or desynchronized with the driving shaft by the second clutch element 47.

In one embodiment of the present disclosure, when the first clutch element 46 and the second clutch element 47 are in the releasing state, the first rotation shaft 41 and the second rotation shaft 42 rotate in the opposite directions based on the rotational relationship of the planetary gear. That is, the drum 30 and the rotator 100 rotate in the opposite directions.

In one example, when the first clutch element 46 is in the restricting state, the rotations of the ring gear and the first rotation shaft 41 are restricted, and the rotation of the second rotation shaft 42 is performed. That is, the drum 30 is in a stationary state and only the rotator 100 rotates. In this connection, the rotation direction of the rotator 100 may be determined based on the rotation direction of the driver 50.

In one example, when the second clutch element 47 is in the restricting state, the rotations of the driving shaft and the first rotation shaft 41 are mutually restricted to each other, and the rotations of the driving shaft, the first rotation shaft 41, and the second rotation shaft 42 may be mutually restricted to each other by the rotational relationship of the planetary gear. That is, the drum 30 and the rotator 100 rotate in the same direction.

When the first clutch element 46 and the second clutch element 47 are in the restricting state at the same time, the driving shaft, the first rotation shaft 41, and the second rotation shaft 42 are all in the stationary state. The controller 70 may implement a necessary driving state by appropriately controlling the driver 50, the first clutch element 46, the second clutch element 47, and the like in the washing process, the rinsing process, and the like.

Figure 3:
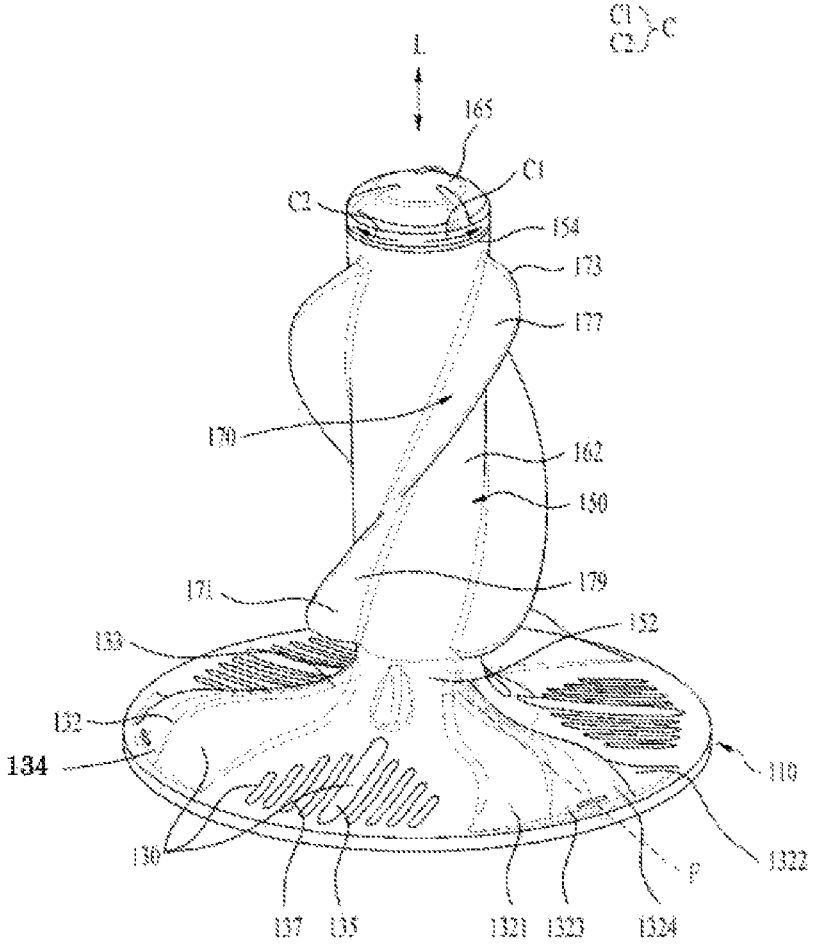
FIG. 3 is a perspective view illustrating a rotator of a laundry treating apparatus according to an embodiment of the present disclosure.

In one example, FIG. 3 is a perspective view of the rotator 100 according to an embodiment of the present disclosure. In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The second rotation shaft 42 described above may be coupled to the bottom portion 110.

That is, the first rotation shaft 41 may be coupled to the drum 30, and the second rotation shaft 42 constructed as the solid shaft inside the hollow first rotation shaft 41 may penetrate the bottom surface 33 of the drum 30 and be coupled to the bottom portion 110 of the rotator 100.

The rotator 100 coupled to the second rotation shaft 42 may rotate independently with respect to the drum 30. That is, the rotator 100 may be rotated in the direction the same as or opposite to that of the drum 30, and such rotation direction may be selected by the controller 70 or the like when necessary.

The first rotation shaft 41 may be coupled to a center of the bottom surface 33 of the drum 30. FIG. 1 shows that the top surface of the drum 30 is opened to define the open surface 31 according to an embodiment of the present disclosure, and the bottom surface thereof corresponds to the bottom surface 33.

That is, the laundry treating apparatus 1 shown in FIG. 1 corresponds to a top loader. The drum 30 may have a side surface, that is, an outer circumferential surface, that connects the top surface with the bottom surface, and a cross-section of the drum 30 may have a circular shape for balancing the rotation. That is, the drum 30 may have a cylindrical shape.

The second rotation shaft 42 may be coupled to a center of the bottom portion 110 of the rotator 100. The second rotation shaft 42 may be coupled to one surface facing the drum 30, that is, a bottom surface of the bottom portion 110, or the second rotation shaft 42 may pass through a center of the drum 30 to be coupled to the bottom portion 110.

The bottom portion 110 may have a circular cross-section in consideration of balancing of the rotation. The bottom portion 110 may be rotated about the second rotation shaft 42 coupled to the center thereof, and the center of the bottom portion 110 may coincide with the center of the drum 30.

The bottom portion 110 may basically have a disk shape, and a specific shape thereof may be determined in consideration of a connection relationship between a protrusion portion 130, the pillar 150, and the like as will be described later.

The bottom portion 110 may cover at least a portion of the drum 30. The bottom portion 110 may be constructed such that the bottom surface thereof and the drum 30 are spaced apart from each other to facilitate the rotation. However, a spaced distance between the bottom portion 110 and the bottom surface 33 of the drum 30 may be varied as needed.

In one example, as shown in FIG. 3, the pillar 150 may have a shape protruding from the bottom portion 110 toward the open surface 31. The pillar 150 may be integrally formed with the bottom portion 110 or manufactured separately and coupled to the bottom portion 110.

The pillar 150 may be rotated together with the bottom portion 110. The pillar 150 may extend from the center of the bottom portion 110 toward the open surface 31. FIG. 1 shows the pillar 150 protruding upwardly from the bottom portion 110 according to an embodiment of the present disclosure. The pillar 150 may have a circular cross-section, and a protruding height from the bottom portion 110 may vary.

The pillar 150 may have a curved side surface forming an outer circumferential surface 162, the rotator 100 may include the blade 170, and the blade 170 may be disposed on the outer circumferential surface 162 of the pillar 150.

The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction C of the pillar 150, and may extend from the bottom portion 110 to the open surface 31 along a direction inclined with respect to a longitudinal direction L of the pillar 150.

Specifically, as shown in FIG. 3, the blade 170 may extend approximately along the longitudinal direction L of the pillar 150. The plurality of blades 170 may be disposed, and the number of blades may vary as needed. FIG. 3 shows a state in which three blades 170 are disposed on the outer circumferential surface 162 of the pillar 150 according to an embodiment of the present disclosure.

The blades 170 may be uniformly disposed along the circumferential direction C of the pillar 150. That is, spaced distances between the blades 170 may be the same. When viewed from the open surface 31 of the drum 30, the blades 170 may be spaced apart from each other at an angle of 120 degrees with respect to a center of the pillar 150.

The blade 170 may extend along a direction inclined with respect to the longitudinal direction L or the circumferential direction C of the pillar 150. The blade 170 may extend obliquely from the bottom portion 110 to the open surface 31 on the outer circumferential surface 162 of the pillar 150. An extended length of the blade 170 may be varied as needed.

As the blade 170 extends obliquely, when the rotator 100 is rotated, an ascending or descending water flow may be formed in the water inside the drum 30 by the blade 170 of the pillar 150.

For example, when the blade 170 extends from the bottom portion 110 toward the open surface 31 while being inclined with respect to one direction C1 among the circumferential directions C of the pillar 150, the descending water flow may be formed by the inclined shape of the blade 170 when the rotator 100 rotates in said one direction C1, and the ascending water flow may be formed by the blade 170 when the rotator 100 is rotated in the other direction C2.

In one embodiment of the present disclosure, said one direction C1 and the other direction C2 of the circumferential direction C of the pillar 150 may correspond to directions opposite to each other with respect to the outer circumferential surface 162 of the pillar 150, and may be a direction perpendicular to the longitudinal direction L of the pillar 150.

Said one direction C1 and the other direction C2 of the circumferential direction C of the pillar 150 may correspond to the rotation direction of the rotator 100. Because the rotation direction of the rotator 100 and the circumferential direction C of the pillar 150 are parallel to each other, the rotator 100 may be rotated in said one direction C1 or rotated in the other direction C2.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various washing schemes may be implemented by appropriately utilizing the ascending water flow and the descending water flow.

The blade 170 according to an embodiment of the present disclosure may have a screw shape. That is, the plurality of blades 170 may be disposed and be spaced apart from each other along the circumferential direction C of the pillar 150, and may extend in the form of the screw from one end 171 ("first end") facing the bottom portion 110 to the other end 173 ("second end") facing the open surface 31.

In other words, in one embodiment of the present disclosure, the plurality of blades 170 may extend while being wound on the outer circumferential surface 162 from said one end 152 facing the bottom portion 110 to the other end 154 facing the open surface 31.

In one example, when referring to FIG. 3, in one embodiment of the present disclosure, the blade 170 may be inclined in said one direction C1 among the circumferential directions C of the pillar 150 with respect to the longitudinal direction L of the pillar 150, and may extend from said one end 171 to the other end 173.

That is, the blade 170 may be constructed to be inclined in only said one direction C1 and not to be inclined in the other direction C2. When the inclination direction of the blade 170 is changed to the other direction C2 during the extension, during the rotation of the rotator 100, a portion of the blade 170 may generate the ascending water flow and the remaining portion may generate the descending water flow.

In this case, the ascending water flow and the descending water flow may occur simultaneously in the rotation of the rotator 100 in said one direction C1, so that it may be difficult to maximize the effect of either ascending or descending of the water.

Accordingly, in one embodiment of the present disclosure, the blade 170 extends obliquely with respect to the longitudinal direction L of the pillar 150, and extends obliquely to said one direction C1 among the circumferential directions C of the pillar 150, so that water flow characteristics for the rotation of the rotator 100 in said one direction C1 and the other direction C2 may be maximized. Said one direction C1 may be one of a clockwise direction and a counterclockwise direction, and the other direction C2 may be the other one.

In one example, in one embodiment of the present disclosure as shown in FIG. 3, the blade 170 may continuously extend from said one end 171 to the other end 173. That is, the blade 170 may be continuously extended without being cut between said one end 171 and the other end 173.

In addition, the blade 170 may extend from said one end 171 to the other end 173 to be continuously inclined with respect to the longitudinal direction L of the pillar 150. That is, the blade 170 may be formed in an inclined shape as a whole without a portion parallel to the longitudinal direction L of the pillar 150.

When at least a portion of the blade 170 is parallel to the longitudinal direction L or the circumferential direction C of the pillar 150, it may be disadvantageous to forming the ascending water flow or the descending water flow resulted from the rotation of the pillar 150. Accordingly, in one embodiment of the present disclosure, the blade 170 is inclined with respect to the longitudinal direction L of the pillar 150 over an entire length.

Figure 4:
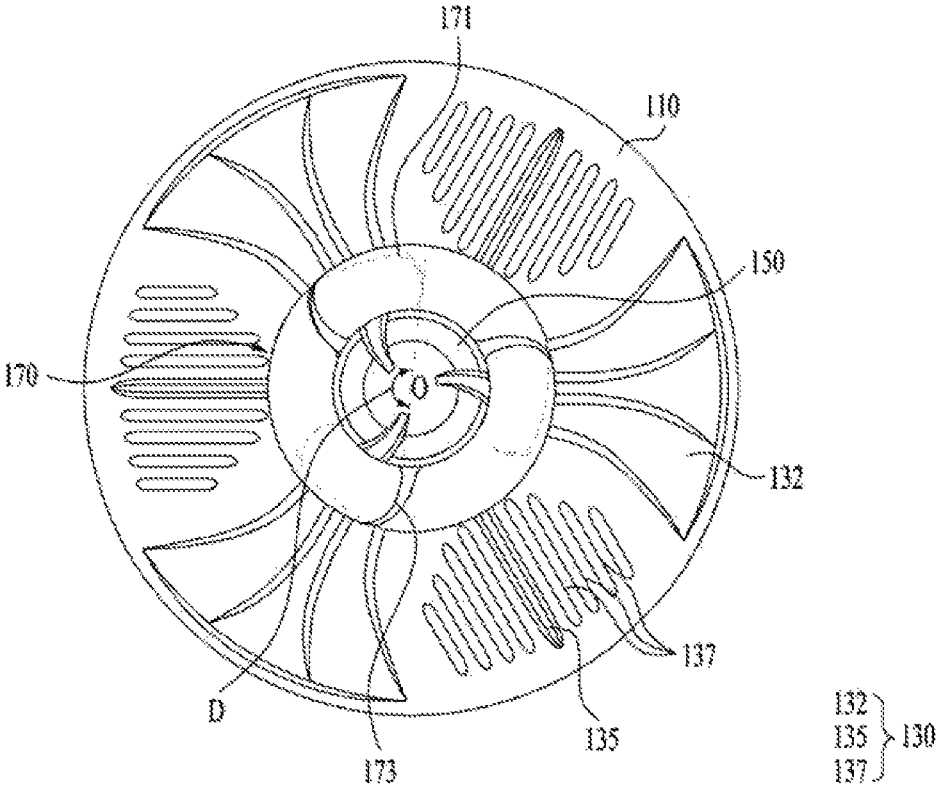
FIG. 4 is a view of a protrusion portion formed on a bottom portion of a rotator in a laundry treating apparatus according to an embodiment of the present disclosure viewed from the top.
Figure 5:
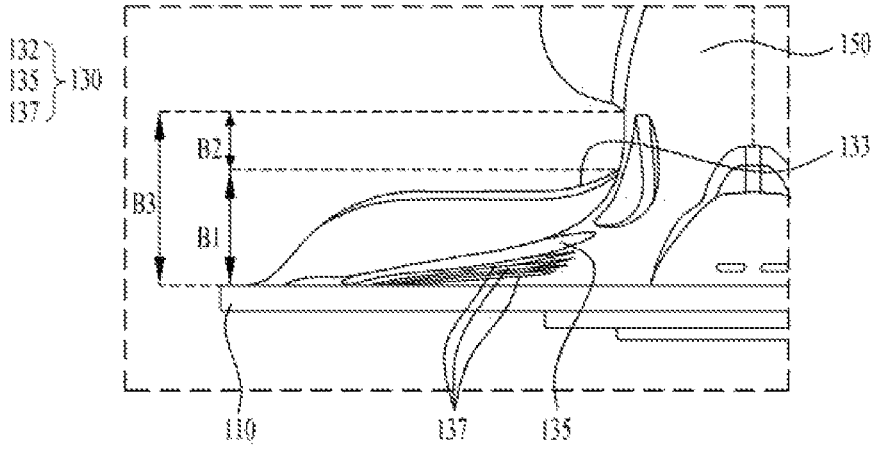
FIG. 5 is a view of a protrusion portion formed on a bottom portion of a rotator in a laundry treating apparatus according to an embodiment of the present disclosure viewed from the side.

FIG. 4 is a view of a protrusion portion formed on a bottom portion of a rotator in a laundry treating apparatus according to an embodiment of the present disclosure viewed from the top, and FIG. 5 is a view of a protrusion portion formed on a bottom portion of a rotator in a laundry treating apparatus according to an embodiment of the present disclosure viewed from the side.

Referring to FIGS. 4 and 5, the laundry treating apparatus 1 according to an embodiment of the present disclosure may further include the protrusion portion 130. The protrusion portion 130 may protrude from the bottom portion 110 toward the open surface 31, extend along a radial direction of the bottom portion 110, and may include a plurality of protrusion portions spaced apart from each other along the circumferential direction of the bottom portion 110.

The protrusion portion 130 protrudes from the bottom portion 110 toward the open surface 31, and extends along the radial direction of the bottom portion 110 to form the water flow in the water inside the tub 20 when the bottom portion 110 rotates. That is, in one embodiment of the present disclosure, when the rotator 100 is rotated, the blade 170 of the pillar 150 and the protrusion portion 130 of the bottom portion 110 may form the water flow together.

The shape of the protrusion portion 130 may vary. For example, a thickness of the protrusion portion 130 may be constant or may vary when necessary. A protruding height or an extended length of the protrusion portion 130 may also be variously determined.

In one embodiment of the present disclosure, as the protrusion portion 130 of the bottom portion 110 is disposed together with the blade 170 of the pillar 150, the blade 170 and the protrusion portion 130 form the water flow together, so that the water flow forming effect may be effectively improved. In addition, because the blade 170 and the protrusion portion 130 cooperatively form the water flow, the washing effect by the water flow may be increased and the shape of the water flow may be improved.

In one example, FIG. 5 shows the protrusion portion 130 shown in FIG. 4 as viewed from the side, that is, the circumferential direction of the bottom portion 110. Referring to FIGS. 4 and 5, in one embodiment of the present disclosure, at least two of the plurality of protrusions of protrusion portion 130 may have different protruding heights from the bottom portion 110.

In one embodiment of the present disclosure, as the plurality of protrusions are constructed to have different heights, when the rotator 100 is rotated, the water flow by the protrusion 130 may be generated in a three-dimensional form, thereby effectively improving a washing performance.

In one embodiment of the present disclosure, one of the plurality of protrusion portions may have a protruding height of a first height, and another may have a protruding height of a second height. The first height may be greater than second height. Therefore, the protrusion portion of the first height may be advantageous in forming a water flow of a larger scale than the protrusion portion of the second height. The protrusion portion of the second height may contribute to stabilizing or maintaining the water flow formed by the protrusion portion of the first height.

In one embodiment of the present disclosure, in addition to the protrusion portions of the first height and the second height, the protrusion portions having various heights may be disposed.

In one example, referring to FIGS. 4 and 5, in one embodiment of the present disclosure, the protrusion portion 130 may include a main protrusion 132. A plurality of main protrusions 132 may be disposed and may include an inner end 133 facing the pillar 150. The inner end 133 of the main protrusion 132 may be connected to the pillar 150.

The inner end 133 of the main protrusion 132 may face the center of the bottom portion 110. That is, the inner end 133 of the main protrusion 132 may face the pillar 150. An outer end 134 of the main protrusion 132 may face a circumferential side of the bottom portion 110. That is, the outer end 134 of the main protrusion 132 may face the opposite side of the inner end 133.

The plurality of protrusion portions may include protrusions having different characteristics. The inner end 133 of the main protrusion 132 among the plurality of protrusion portions may be connected to the pillar 150. The main protrusion 132 may be integrally molded with the bottom portion 110 or may be separately manufactured and coupled thereto. The inner end 133 of the main protrusion 132 may be integrally formed with the pillar 150 or manufactured separately and coupled and connected to the pillar 150.

FIGS. 4 and 5 show the main protrusion 132 integrally molded with the bottom portion 110 according to an embodiment of the present disclosure, and connected to the pillar 150 as the inner end 133 thereof is integrally molded with the pillar 150.

The main protrusion 132 may greatly contribute to the formation of the water flow among the plurality of protrusion portions when the bottom portion 110 rotates. For example, the main protrusion 132 may be constructed such that a protruding height B1 thereof from the bottom portion 110, which is the first height, is the greatest among the protruding heights of the plurality of protrusion portions, and the inner end 133 and the pillar 150 are connected to each other, so that the main protrusion 132 may greatly contribute to the formation of the water flow.

In one example, as shown in FIGS. 4 and 5, in one embodiment of the present disclosure, the protrusion portion 130 may further include a first sub-protrusion 135. There may be a plurality of first sub-protrusions 135, and each first sub-protrusion 135 may be disposed between a pair of main protrusions 132. A protruding height from the bottom portion 110 of the first sub-protrusion 135 may be smaller than that of the main protrusion 132.

The main protrusion 132 may extend from the pillar 150 to a circumference of the bottom portion 110, and the first sub-protrusion 135 may have a smaller extended length than the main protrusion 132. A protruding height of the first sub-protrusion 135 may be smaller than the protruding height B1 of the main protrusion 132.

For example, the protruding height of the first sub-protrusion 135 may correspond to the second height, the main protrusion 132 may have the protruding height B1 corresponding to the first height, and the second height may correspond to a height smaller than the first height.

The first sub-protrusion 135 may be disposed between the two main protrusions 132. The number of the main protrusions 132 and the number of first sub-protrusions 135 may be variously designed as needed. The number of the main protrusions 132 may correspond to the number of the blades 170.

FIGS. 4 and 5 show the rotator 100 having the three blades 170, having the three main protrusions 132, and having each first sub-protrusion 135 between a pair of main protrusions 132, which is a total of three first sub-protrusions 135, according to an embodiment of the present disclosure.

In one embodiment of the present disclosure, as the number of the protrusion portions disposed on the bottom portion 110 increases, it may be advantageous to form the water flow. However, when the plurality of protrusion portions are made of only the main protrusions 132, the number of the main protrusions 132 may be limited by a size of the main protrusions 132. As a distance between the main protrusions 132 becomes smaller, a space between the main protrusions 132 may not affect the water flow formation and may adversely affect an increase in a washing capacity, such as forming an unnecessary vortex.

In one embodiment of the present disclosure, as the first sub-protrusion 135 rather than the main protrusion 132 is disposed between the pair of main protrusions 132, the space between the pair of main protrusions 132 may be sufficiently secured. In the space between the pair of main protrusions 132, the first sub-protrusion 135 flows the water, which is advantageous for the formation of the water flow.

Shapes of the main protrusion 132 and the first sub-protrusion 135 may vary when need. FIG. 4 shows a state in which the main protrusion 132 has a streamline-shaped side surface, and the first sub-protrusion 135 is formed in a rib shape according to an embodiment of the present disclosure.

The main protrusion 132 may be constructed such that a width thereof in the circumferential direction of the bottom portion 110 increases from the inner end 133 toward the outer end 134, and an increase rate of the width may increase toward the outer end 134.

That is, the main protrusion 132 may have a shape of a whale tail that increases in width toward the circumference of the bottom portion 110 and have a side surface forming a concave curved surface. The main protrusion 132 having the whale tail shape may reduce resistance by water when the bottom portion 110 rotates, and may improve fluidity of water. Because the water flow flowing by the main protrusion 132 may flow to said one end 171 of the blade 170, it may be advantageous to form the water flow.

The first sub-protrusion 135 may be formed in a shape of a rib extending from the pillar 150 to the circumference of the bottom portion 110. However, the shapes of the main protrusion 132 and the first sub-protrusion 135 are not necessarily limited as described above, and may be variously designed as needed.

In one example, as shown in FIGS. 4 and 5, in one embodiment of the present disclosure, the protrusion portion 130 may further include a second sub-protrusion 137. The second sub-protrusion 137 may be disposed between the main protrusion 132 and the first sub-protrusion 135, and a protruding height from the bottom portion 110 of the second sub-protrusion 137 may be smaller than that of the first sub-protrusion 135.

The second sub-protrusion 137 may be disposed between one main protrusion 132 and one first sub-protrusion 135 positioned adjacent to said one main protrusion 132. That is, the second sub-protrusion 137 may be disposed between the main protrusion 132 and the first sub-protrusion 135.

The second sub-protrusion 137 may be integrally formed with the bottom portion 110 or manufactured separately and coupled to the bottom portion 110. FIGS. 4 and 5 show the second sub-protrusion 137 integrally formed with the bottom portion 110 according to an embodiment of the present disclosure.

The second sub-protrusion 137 may have a smaller protruding height than the first sub-protrusion 135. For example, in one embodiment of the present disclosure, the protruding height B1 of the main protrusion 132 may correspond to the first height, the protruding height of the first sub-protrusion 135 may correspond to the second height smaller than the first height, and the protruding height of the second sub-protrusion 137 may correspond to a third height smaller than the second height.

That is, in one embodiment of the present disclosure, the plurality of protrusion portions may have the main protrusion 132, the first sub-protrusion 135, and the second sub-protrusion 137 having the different heights. Accordingly, the water flow by the bottom portion 110 may be formed three-dimensionally and effectively.

In one example, referring to FIG. 4, in one embodiment of the present disclosure, a plurality of second sub-protrusions 137 may be disposed between the main protrusion 132 and the first sub-protrusion 135, and an extended length thereof may increase as being closer to the first sub-protrusion 135.

The number of the second sub-protrusions 137 disposed between one main protrusion 132 and one first sub-protrusion 135 may be variously determined as needed. FIG. 4 shows a state in which four second sub-protrusions 137 are disposed between each main protrusion 132 and each first sub-protrusion 135 according to an embodiment of the present disclosure.

Lengths of the plurality of second sub-protrusions 137 disposed between one main protrusion 132 and one first sub-protrusion 135 may increase in a direction toward the first sub-protrusion 135 and decrease in a direction toward the main protrusion 132.

Accordingly, the plurality of second sub-protrusions 137 may continuously complement the flow of water between the main protrusion 132 and the first sub-protrusion 135 to improve fluidity.

The second sub-protrusion 137 may have an extending direction parallel to the first sub-protrusion 135. Accordingly, an inner end of one of the plurality of second sub-protrusions 137 located far from the first sub-protrusion 135 may not face the pillar 150.

The second sub-protrusions 137 may be disposed together with the first sub-protrusion 135 to improve the fluidity of water between the main protrusions 132.

Figure 6:
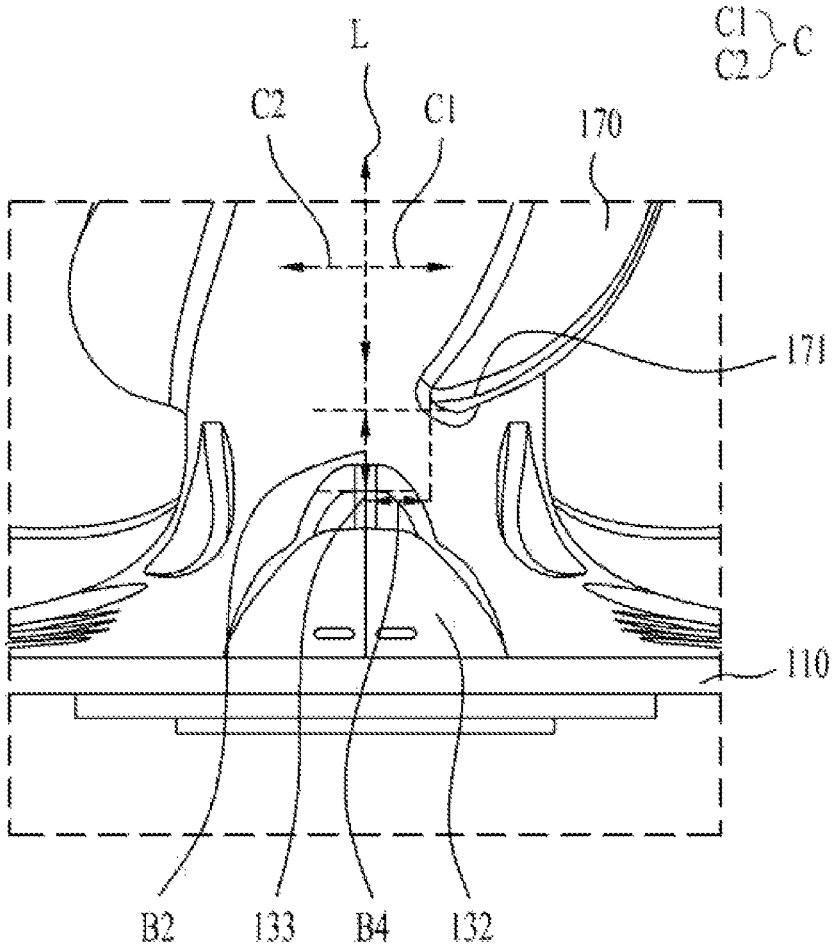
FIG. 6 is a view showing a state in which a protrusion portion of a rotator and a blade are spaced apart from each other in a laundry treating apparatus according to an embodiment of the present disclosure.
Figure 7A:
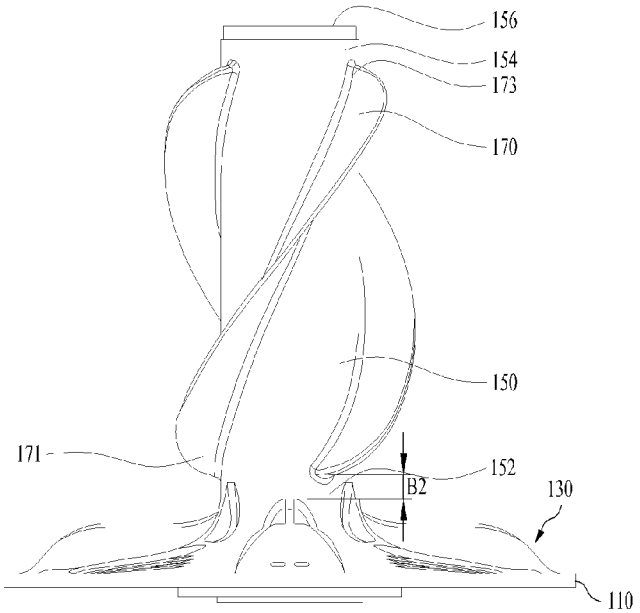
FIGS. 7A and 7B are views showing a transfer of a load of a rotator when washing a small amount of laundry in a laundry treating apparatus according to an embodiment of the present disclosure.
Figure 7B:
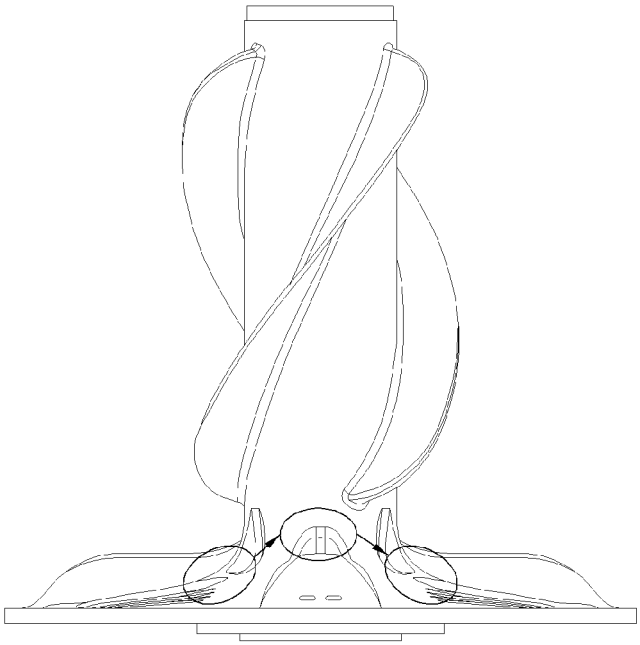

FIG. 6 is a view showing a state in which a protrusion portion of a rotator and a blade are spaced apart from each other in a laundry treating apparatus according to an embodiment of the present disclosure. FIGS. 7A and 7B are views showing a transfer of a load of a rotator when washing a small amount of laundry in a laundry treating apparatus according to an embodiment of the present disclosure. Specifically, FIG. 7A shows a rotator, and FIG. 7B shows a transfer of a load in a rotator when washing a small amount of laundry.

Referring to FIGS. 6 to 7B, in the laundry treating apparatus 1 according to an embodiment of the present disclosure, the blade 170 may be disposed to be spaced apart from the bottom portion 110. Specifically, the laundry treating apparatus 1 may include the tub 20 that provides therein the space in which the water is stored. The laundry treating apparatus 1 may include the drum 30 disposed to be rotatable inside the tub 20, and including the open surface 31 through which the laundry enters and exits, and the bottom surface 33 positioned on the opposite side of the open surface 31. The laundry treating apparatus 1 may include the rotator 100 rotatably disposed on the bottom surface 33 inside the drum 30.

The rotator 100 may include the bottom portion 110 positioned on the bottom surface 33. The rotator 100 may include the pillar 150 protruding from the bottom portion 110 toward the open surface 31. The rotator 100 may include the blade 170 protruding from the outer circumferential surface 162 of the pillar 150, and extending from said one end 171 facing the bottom surface 33 to the other end 173 facing the open surface. The blade 170 may be disposed such that said one end 171 is spaced apart from the bottom portion 110.

The bottom portion 110 may include the protrusion portion 130 protruding from the bottom portion toward the open surface. The protrusion portion 130 may extend along the radial direction of the bottom portion 110.

The protrusion portion 130 may generate the water flow together with the blade 170 during the washing. In addition, the protrusion portion 130 may cause friction or collision with the laundry such that the laundry is washed or rinsed.

The blade 170 may be disposed such that said one end 171 is spaced apart from the protrusion portion 130. That is, in the laundry treating apparatus 1, a water passage region may be defined between the protrusion portion 130 and said one end 171 of the blade 170. Accordingly, the blade 170 and the protrusion portion 130 may generate the water flow for the washing while minimizing the resistance of the water when washing the small amount of laundry. A detailed description will be given later.

The protrusion portion 130 may include the main protrusion 132 extending from the inner end 133 facing toward the center of the bottom portion 110 to the outer end 134 facing toward the circumference of the bottom portion 110. In the main protrusion 132, the inner end 133 may be connected to the pillar 150.

As described above, among the plurality of protrusions of the protrusion portion 130, the main protrusion 132 has the greatest height in the longitudinal direction L of the pillar 150. In addition, among the plurality of protrusions of the protrusion portion 130, the main protrusion 132 has the greatest width in the circumferential direction of the bottom portion 110.

Accordingly, said one end 171 of the blade 170 may be disposed to be spaced apart from the main protrusion 132. That is, the blade 170 may be spaced apart from the main protrusion 132 of the protrusion portion 130 to sufficiently secure the passage region of the water.

In one example, in the laundry treating apparatus 1 according to an embodiment of the present disclosure, the main protrusion 132 may extend such that a height thereof in the longitudinal direction L of the pillar 150 decreases from the inner end 133 of the main protrusion 132 to the outer end 134 of the main protrusion 132.

That is, in the main protrusion 132, the inner end 133 may be positioned closest to the open surface 31 in the longitudinal direction L of the pillar 150. That is, the inner end 133 may have the largest height in the longitudinal direction L of the pillar 150 from the bottom portion 110.

The blade 170 may be disposed such that said one end 171 is spaced apart from the inner end 133 by a first spaced distance B2 in the longitudinal direction L of the pillar 150. That is, a reference for spacing apart from the bottom portion 110 of the blade 170 may be the inner end 133. Accordingly, the rotator 100 may easily set a reference point in manufacturing the blade 170.

In addition, the blade 170 is spaced apart from the highest point of the bottom portion 110 in the longitudinal direction L of the pillar 150, so that the water passage region may be easily secured.

In addition, the rotator 100 may be manufactured by injection molding. In this connection, the rotator 100 may be manufactured with a sliding core. When the rotator 100 is manufactured with the sliding core, a manufacturing cost may be reduced. The main protrusion 132 may extend from the bottom surface 33 to decrease in height from the inner end 133 to the outer end, so that an undercut may not occur. Accordingly, the rotator 100 may be easily manufactured with the sliding core.

Referring to FIGS. 3, 6, 7A and 7B, as described above, the main protrusion 132 may have the streamlined-shaped side surface. The main protrusion 132 may be constructed such that the width thereof in the circumferential direction of the bottom portion 110 increases from the inner end 133 toward the outer end 134, and the increase rate of the width may increase toward the outer end 134. That is, the main protrusion 132 may have the shape of the whale tail that increases in the width toward the circumference of the bottom portion 110 and have the side surface forming the concave curved surface.

In addition, when viewed in the longitudinal direction L of the pillar 150, the main protrusion 132 may have a first concave portion 1321 concavely protruding from the bottom portion 110 toward the open surface 31. In addition, the main protrusion 132 may include a first convex portion 1323 convexly protruding from the first concave portion 1321 toward the open surface 31. In addition, the main protrusion 132 may include a second convex portion 1324 extending from the first convex part 1323 toward the bottom surface 33 and convexly protruding toward the open surface 31. In addition, the main protrusion 132 may include a second concave portion 1322 extending from the second convex portion 1324 toward the bottom surface 33 and concavely protruding toward the open surface 31.

In addition, the main protrusion 132 may be positioned parallel to a radius of the bottom portion 110 and constructed symmetrically with respect to an imaginary line F passing through a center of the main protrusion 132. That is, the first concave portion 1321 may be disposed symmetrically with the second concave portion 1322 with respect to the virtual line F. In addition, the first convex portion 1323 may be disposed symmetrically with the second convex portion 1324 based on the virtual line F.

An amount of water input to the drum 30 is less when the small amount of laundry is washed than when the large amount of laundry is washed. Accordingly, when the small amount of laundry is washed, the main protrusion 132 having the whale tail shape may be partially submerged in the water. In addition, when the small amount of laundry is washed, the main protrusion 132 having the whale tail shape may be fully submerged. In addition, when the small amount of laundry is washed, the main protrusion 132 having the whale tail shape and a portion of the blade 170 may be submerged.

That is, when the small amount of laundry is washed, a water flow with a height in the longitudinal direction L of the pillar 150 smaller than that in the case in which the large amount of laundry is washed may be generated. Accordingly, when the small amount of laundry is washed, the water flow may be generated only by the protrusion portion 130.

Said one end 171 of the blade 170 is spaced apart from the inner end 133 of the main protrusion 132 in the longitudinal direction L of the pillar 150 to define the passage region of water. The water flow generated when the small amount of laundry is washed may be reduced in resistance by the passage region of the water. Thus, the washing efficiency may be increased.

In addition, a small load applied to the rotator 100 may be transferred along the main protrusion 132. In the rotator 100, the small load may transfer while avoiding the blade 170 by the passage region of the water. That is, the small load applied to the rotator 100 may sequentially pass the first concave portion 1321, the first convex portion 1323, the second convex portion 1324, and the first concave portion 1321. Accordingly, the driving load of the driver 50 rotating the rotator 100 may be reduced.

In one example, the rotator 100 may be rotatable in the clockwise or counterclockwise direction. That is, the rotator 100 may be rotated in said one direction C1 or the other direction C2. When the rotator 100 is rotated in the clockwise direction, the small load may be transferred from the first concave portion 1321 to the second concave portion 1322.

Conversely, when the rotator 100 is rotated in the counterclockwise direction, the small load may be transferred from the second concave portion 1322 to the first concave portion 1321. The small load applied to the rotator 100 may sequentially pass the second concave portion 1322, the second convex portion 1324, the first convex portion 1323, and the first concave portion 1321.

That is, in the rotator 100, the small load may be transferred naturally regardless of the rotation direction of the rotator 100. Accordingly, the driving load of the driver 50 rotating the rotator 100 may be reduced regardless of the rotation direction of the rotator 100.

Figure 8A:
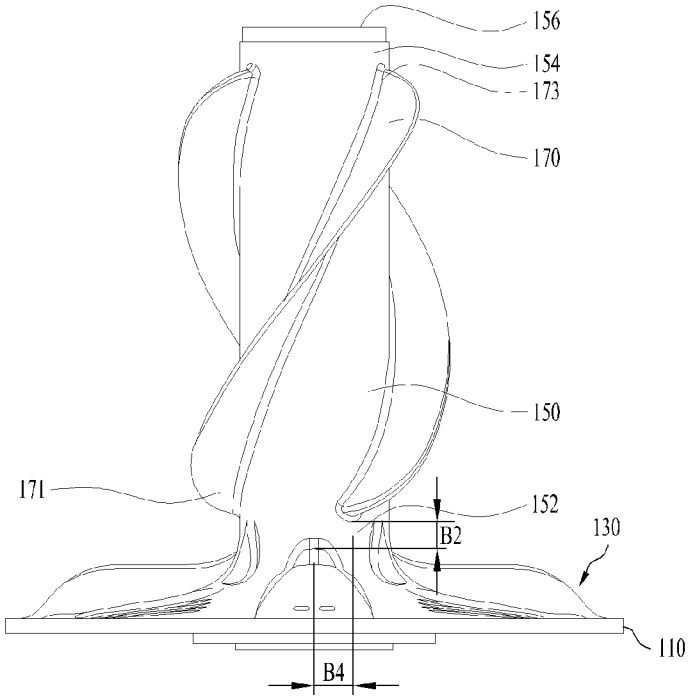
FIGS. 8A and 8B are views showing a transfer of a load of a rotator when washing a large amount of laundry in a laundry treating apparatus according to an embodiment of the present disclosure.
Figure 8B:
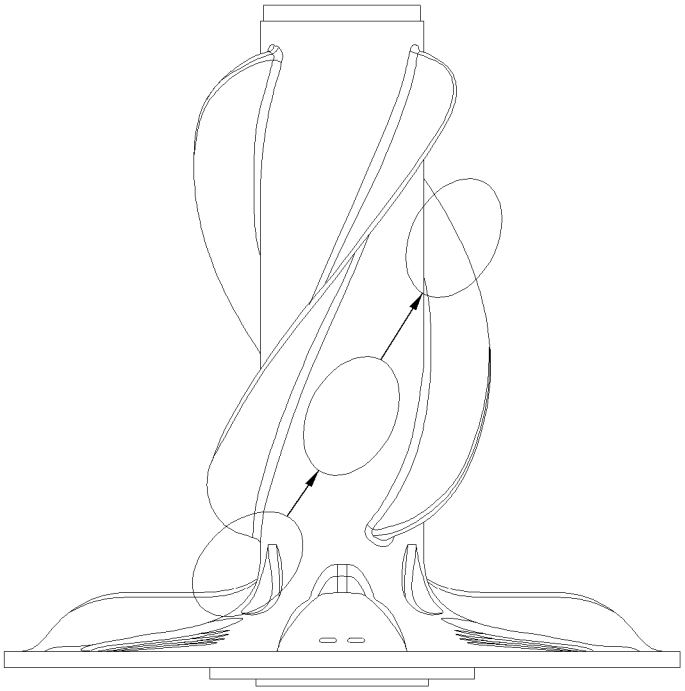

FIG. 6 is a view showing a state in which a protrusion portion of a rotator and a blade are spaced apart from each other in a laundry treating apparatus according to an embodiment of the present disclosure. FIGS. 8A and 8B are views showing a transfer of a load of a rotator when washing a large amount of laundry in a laundry treating apparatus according to an embodiment of the present disclosure. Specifically, FIG. 8A shows a rotator, and FIG. 8B shows a load transfer in a rotator when washing a large amount of laundry.

Referring to FIGS. 3, 6, 8A, and 8B, as described above, the main protrusion 132 may have the streamlined-shaped side surface. The main protrusion 132 may be constructed such that the width thereof in the circumferential direction of the bottom portion 110 increases from the inner end 133 toward the outer end 134, and the increase rate of the width may increase toward the outer end 134. That is, the main protrusion 132 may have the shape of the whale tail that increases in the width toward the circumference of the bottom portion 110 and have the side surface forming the concave curved surface.

In addition, when viewed in the longitudinal direction L of the pillar 150, the main protrusion 132 may have the first concave portion 1321 concavely protruding from the bottom portion 110 toward the open surface 31. In addition, the main protrusion 132 may include the first convex portion 1323 convexly protruding from the first concave portion 1321 toward the open surface 31. In addition, the main protrusion 132 may include the second convex portion 1324 extending from the first convex part 1323 toward the bottom surface 33 and convexly protruding toward the open surface 31. In addition, the main protrusion 132 may include the second concave portion 1322 extending from the second convex portion 1324 toward the bottom surface 33 and concavely protruding toward the open surface 31.

In addition, the main protrusion 132 may be positioned parallel to the radius of the bottom portion 110 and constructed symmetrically with respect to the imaginary line F passing through the center of the main protrusion 132. That is, the first concave portion 1321 may be disposed symmetrically with the second concave portion 1322 with respect to the virtual line F. In addition, the first convex portion 1323 may be disposed symmetrically with the second convex portion 1324 based on the virtual line F.

An amount of water input to the drum 30 is greater when the large amount of laundry is washed than when the small amount of laundry is washed. Accordingly, when the large amount of laundry is washed, an entirety of the main protrusion 132 having the whale tail shape and a portion of the blade 170 may be submerged in the water. That is, when the large amount of laundry is washed, a water flow with a height in the longitudinal direction L of the pillar 150 greater than that in the case in which the small amount of laundry is washed may be generated.

Accordingly, the blade 170 may be constructed such that said one end 171 is spaced apart from the inner end 133 by a second spaced distance B4 in the circumferential direction C of the pillar 150. In other words, an extension line extending from the first concave portion 1321 along the second convex portion 1324 and facing toward the open surface 31 may be connected to an extension line from said one end 171 of the blade 170 toward the bottom surface 33.

That is, the water flow generated by the main protrusion 132 may flow along the blade 170. In addition, the water flow generated by the main protrusion 132 may be combined with the water flow generated by the blade 170. In this connection, as for the blade 170, said one end 171 is spaced apart from the inner end 133 of the main protrusion 132 in the circumferential direction C of the pillar 150 to define a water flow region. The water flow generated when the large amount of laundry is washed may have a reduced resistance by the flow region of the water. Accordingly, the washing efficiency may be increased.

In addition, a large load applied to the rotator 100 may be transferred along the main protrusion 132. In the rotator 100, the large load may be prevented from contacting said one end 171 of the blade 170 as much as possible because of the flow region of the water and may be transferred toward the other end 173 of the blade 170.

That is, the large load applied to the rotator 100 may sequentially pass the first concave portion 1321, the first convex portion 1323, said one end 171 of the blade 170, and the other end 173 of the blade 170. Accordingly, the driving load of the driver 50 rotating the rotator 100 may be reduced.

In one example, referring to FIGS. 6, 7A, 7B, 8A and 8B, in the laundry treating apparatus 1 according to an embodiment of the present disclosure, said one end 171 of the blade 170 may be disposed to be spaced apart from the inner end 133 by the first spaced distance B2 in the longitudinal direction L of the pillar 150. In addition, in the blade 170, said one end 171 may be spaced apart from the inner end 133 by the second spaced distance B4 in the circumferential direction C of the pillar 150.

Accordingly, in the rotator 100, both the passage region of the water and the flow region of the water may be defined. Accordingly, the rotator 100 may be reduced in the resistance in the generation of the water flow regardless of the amount of laundry during the rotation. In addition, both the small load and the large load mat be smoothly transferred along the main protrusion 132 or the blade 170, so that the driving load on the driver 50 may be reduced. Furthermore, the blade 170 and the main protrusion 132 may be prevented from being damaged as much as possible as the load is decreased.

When the first spaced distance B2 is large, a length of the blade 170 may be reduced and an inclination angle of the blade 170 extending from said one end 171 to the other end 173 may be reduced. Accordingly, a load applied to the blade 170 may be increased to increase a possibility of damage of the blade 170. In addition, a dead space of the pillar 150 in which the blade 170 is not disposed may be increased, and thus a space efficiency may be reduced.

Therefore, the first spaced distance B2 may be variously determined in consideration of a length of the pillar 150, the length of the blade 170, a thickness of the blade 170, the height of the main protrusion 132, the inclination angle of the blade 170, and the like. That is, the first spaced distance B2 may be determined to minimize the resistance when the water flow is generated, minimize the driving load of the driver 50, and minimize the load applied to the blade 170.

The plurality of blades 170 may be spaced apart from each other along the circumferential direction of the pillar 150. Accordingly, when the second spaced distance B4 is large, the inclination angle of the blade 170 extending from said one end 171 to the other end 173 may be decreased. Accordingly, the load applied to the blade 170 may be increased to increase the possibility of damage. In addition, the dead space of the pillar 150 in which the blade 170 is not disposed may be increased, and thus the space efficiency may be reduced.

Therefore, the second spaced distance B4 may be variously determined in consideration of a circumference of the pillar 150, the length of the blade 170, the thickness of the blade 170, the height of the main protrusion 132, the inclination angle of the blade 170, and the like. That is, the second spaced distance B4 may be determined to minimize the resistance when the water flow is generated, minimize the driving load of the driver 50, and minimize the load applied to the blade 170.

The first spaced distance B2 may be greater than the second spaced distance B4. That is, the length in the longitudinal direction of the pillar 150 may be greater than the circumference of the pillar 150. Accordingly, the decrease in the length of the blade 170 in the longitudinal direction of the pillar 150 or of the inclination angle of the blade 170 may be prevented as much as possible. Accordingly, it is possible to easily secure the passage region of the water and the flow region of the water while minimizing the load applied to the blade 170. In addition, the driving load of the driver 50 may be effectively reduced.

In addition, in the main protrusion 132, the height of the inner end 133 from the bottom surface 33 may be greater than the first spaced distance B2. In addition, the height of the main protrusion 132 from the bottom surface 33 may be greater than the second spaced distance B4.

The main protrusion 132 may improve the washing efficiency through the generation of the water flow and the friction with the laundry. Accordingly, when the first spaced distance B2 or the second spaced distance B4 is greater than the height of the main protrusion 132, the main protrusion 132 may not be able to effectively generate the water flow together with the blade 170. In other words, the height of the main protrusion 132 may be greater than the first spaced distance B2 or the second spaced distance B4 to effectively generate the water flow and reduce the resistance at the time when the water flow is generated. In addition, the driving load of the driver 50 may be effectively reduced.

In one example, referring to FIGS. 3, 7A, 7B, 8A and 8B, in the laundry treating apparatus 1 according to an embodiment of the present disclosure, the pillar 150 may be formed in a hollow shape. In addition, the rotator 100 may include a cap 165 coupled to an end of the pillar 150 to close an interior of the pillar 150. Accordingly, a material of the pillar 150 used may be reduced during manufacturing. In addition, a weight of the pillar 150 is reduced, so that the driving load of the driver 50 may be reduced when rotating.

Although the present disclosure has been illustrated and described in relation to a specific embodiment, it is understood that the present disclosure may be variously improved and changed within the scope of the technical idea of the present disclosure provided by the following claims. Therefore, the scope of the present disclosure should not be limited to the described embodiment and should be defined by the claims described later as well as the equivalents of the claims.

What is claimed is:

1. A laundry treating apparatus comprising:

a tub configured to receive water;

a drum rotatably disposed inside the tub, the drum having an open surface that is configured to receive laundry therethrough and a bottom surface located at an opposite side of the open surface; and a rotator rotatably disposed inside the drum, the rotator comprising:

a bottom portion disposed at the bottom surface of the drum, a pillar that protrudes from the bottom portion toward the open surface of the drum, a blade that protrudes from an outer circumferential surface of the pillar and has a first end facing the bottom surface of the drum and a second end facing the open surface of the drum, the blade extending from the first end to the second end, and a protrusion portion that protrudes from the bottom portion toward the open surface and extends along a radial direction of the bottom portion, wherein the protrusion portion comprises a main protrusion that has (i) an inner end facing a center of the bottom portion in the radial direction and (ii) an outer end facing a circumference of the bottom portion in the radial direction, the main protrusion extending from the inner end to the outer end, and wherein the first end of the blade is spaced apart from the inner end of the main protrusion by a circumferential distance in a circumferential direction of the pillar.

2. The laundry treating apparatus of claim 1, wherein the inner end of the main protrusion is connected to the pillar.

3. The laundry treating apparatus of claim 2, wherein the first end of the blade is spaced apart from the inner end of the main protrusion by a longitudinal distance in a longitudinal direction of the pillar.

4. The laundry treating apparatus of claim 3, wherein the longitudinal distance is greater than the circumferential distance.

5. The laundry treating apparatus of claim 3, wherein a height of the inner end of the main protrusion from the bottom surface is greater than the longitudinal distance and the circumferential distance.

6. The laundry treating apparatus of claim 2, wherein the main protrusion extends toward the open surface of the drum, and wherein a height of the main protrusion from the bottom surface decreases from the inner end of the main protrusion to the outer end of the main protrusion.

7. The laundry treating apparatus of claim 2, wherein the protrusion portion comprises:

a plurality of main protrusions that are spaced apart from one another along a circumferential direction of the bottom portion, the plurality of main protrusions including the main protrusion; and a plurality of first sub-protrusions, each of the plurality of first sub-protrusions being disposed between a pair of main protrusions among the plurality of main protrusions, and wherein a protruding height of each of the plurality of first sub-protrusions from the bottom portion is less than a protruding height of the main protrusion from the bottom portion.

8. The laundry treating apparatus of claim 7, wherein the protrusion portion further comprises a plurality of second sub-protrusions, each of the plurality of second sub-protrusions being disposed between one of the plurality of main protrusions and one of the plurality of first sub-protrusions, and wherein a protruding height of each of the plurality of second sub-protrusions from the bottom portion is less than the protruding height of each of the plurality of first sub-protrusions.

9. The laundry treating apparatus of claim 1, wherein the rotator comprises a plurality of blades that are spaced apart from one another along the circumferential direction of the pillar, the plurality of blades including the blade, and wherein each of the plurality of blades is inclined with respect to a longitudinal direction of the pillar and extends from a first position corresponding to the first end of the blade to a second position corresponding to the second end of the blade.

10. The laundry treating apparatus of claim 1, wherein the pillar defines a hollow space in an interior thereof, and wherein the rotator further comprises a cap that is coupled to an end of the pillar and closes the hollow space of the pillar.

11. The laundry treating apparatus of claim 10, wherein the second end of the blade is disposed vertically below the cap.

12. The laundry treating apparatus of claim 10, wherein the cap is located vertically above an upper end of the pillar, and the second end of the blade is disposed vertically below the upper end of the pillar.

13. The laundry treating apparatus of claim 1, wherein the blade has a spiral shape that extends from the first end to the second end.

14. The laundry treating apparatus of claim 13, wherein the rotator is configured to rotate in a clockwise direction or a counterclockwise direction about a longitudinal direction of the pillar, and wherein the blade is curved along one of the clockwise direction or the counterclockwise direction.

15. The laundry treating apparatus of claim 1, further comprising:

a rotation shaft that is coupled to the rotator and extends vertically below the bottom surface of the drum; and a driver located vertically below the bottom surface of the drum, the driving being configured to the rotation shaft and to rotate the rotation shaft.

16. The laundry treating apparatus of claim 15, wherein the rotation shaft comprises:

a first rotation shaft connected to the driver and the bottom surface of the drum, the first rotation shaft being configured to rotate the drum; and a second rotation shaft connected to the driver and the bottom portion of the rotator, the second rotation shaft being configured to rotate the rotator.

17. The laundry treating apparatus of claim 16, wherein the first rotation shaft defines a through-hole that receives the second rotation shaft, and wherein the first rotation shaft and the second rotation shaft are coaxial.

18. The laundry treating apparatus of claim 16, wherein the first rotation shaft and the second rotation shaft are configured to rotate together in one direction or to rotate in opposite directions from each other.

19. The laundry treating apparatus of claim 1, wherein the circumferential distance is defined between the first end of the blade and a reference line extending from the inner end of the main protrusion along a longitudinal direction of the pillar, and wherein the reference line does not pass through the blade.

20. The laundry treating apparatus of claim 1, wherein the rotator comprises a plurality of blades that are spaced apart from one another along the circumferential direction, the plurality of blades including the blade, wherein the protrusion portion comprises a plurality of main protrusions that are spaced apart from one another along the circumferential direction, the plurality of main protrusions including the main protrusion, and wherein the inner end of each of the plurality of main protrusions is spaced apart from the first end of a corresponding one of the plurality of blades by the circumferential distance in the circumferential direction.

* * * * *